US007320406B2

(12) United States Patent
Auclair

(10) Patent No.: US 7,320,406 B2
(45) Date of Patent: Jan. 22, 2008

(54) CARTON INSERT AND PACKAGED CARTON

(75) Inventor: Jean-Michel Auclair, Chateauroux (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 244 days.

(21) Appl. No.: 11/118,055

(22) Filed: Apr. 29, 2005

(65) Prior Publication Data

US 2005/0224390 A1 Oct. 13, 2005

Related U.S. Application Data

(63) Continuation of application No. PCT/US03/34704, filed on Oct. 31, 2003.

(30) Foreign Application Priority Data

Oct. 31, 2002 (GB) ..... 0225355.7

(51) Int. Cl.
*B65D 85/30* (2006.01)

(52) U.S. Cl. ..... 206/588; 206/591; 206/593

(58) Field of Classification Search ..... 206/521.9, 206/583, 588, 591, 593, 594
See application file for complete search history.

(56) References Cited

U.S. PATENT DOCUMENTS

| | | | | |
|---|---|---|---|---|
| 1,725,291 A | | 8/1929 | Moore | |
| 1,910,396 A | | 5/1933 | Koppelman | |
| 2,139,127 A | * | 12/1938 | Mandusky | 206/418 |
| 2,224,850 A | | 12/1940 | Warren | |
| 2,314,951 A | | 3/1943 | Ringler | |
| 2,979,248 A | * | 4/1961 | Washington | 206/591 |
| 3,307,768 A | | 3/1967 | Growney | |
| 3,519,244 A | * | 7/1970 | Lidgard | 206/454 |
| 3,692,173 A | | 9/1972 | Purciel | |
| 4,438,848 A | | 3/1984 | Montealegre et al. | |
| 4,921,099 A | | 5/1990 | Trauschke | |
| 5,339,958 A | | 8/1994 | Taravella et al. | |
| 5,788,077 A | | 8/1998 | Sisk | |
| 6,079,563 A | * | 6/2000 | Katchmazenski | 206/583 |

FOREIGN PATENT DOCUMENTS

| | | |
|---|---|---|
| DE | 2 970 2303 U1 | 5/1997 |
| EP | 0 955 242 A | 11/1999 |
| FR | 2 515 612 | 5/1983 |
| FR | 2 744 985 A | 8/1997 |
| NL | 9 200 380 A | 10/1993 |

* cited by examiner

*Primary Examiner*—David T. Fidei
(74) *Attorney, Agent, or Firm*—Tsugihiko Suzuki

(57) ABSTRACT

An insert suitable for placement within a carton. The insert comprises a support panel capable of supporting an article to be located within the carton, and a pair of leg panels extending convergently downwardly from the opposing side edges of the support panel into abutment at the lower edges of said leg panels. The invention also provides a package wherein a fragile item of merchandise is located within the fully folded insert and placed into a carton, such as a perfume bottle or cosmetic product. The underside of the base of such item of merchandise is conveniently spaced above from the base of the carton to reduce the risks of damage to or breakage of the article.

20 Claims, 8 Drawing Sheets

CARTON INSERT AND PACKAGED CARTON

This is a continuation of international application No. PCT/US2003/034704, filed Oct. 31, 2003, which is hereby incorporated by reference.

BACKGROUND OF THE INVENTION

This invention is concerned with a carton insert and carton. More particularly, it is concerned with a packaging insert for locating an article, such as a perfume bottle, within a display carton.

Packaging of fragile items of merchandise and in particular bottles of perfume or cosmetic products usually requires protective measures to avoid or minimise the risk of damage or breakage to the contained product, in transit or storage. In this regard carton constructions are known, wherein inserts have been constructed to provide such protective measures as cushioning to the contained article. Articles made of or including a significant proportion of glass are susceptible to damage or even breakage, and especially in the case of high value items such as perfume or cosmetics damage or breakage is economically significant. Damage or breakage is most likely to occur during carton stacking or transit, and the present invention seeks to provide an alternative protective measure for delicate items of merchandise packaged within conventional cartons.

Carton constructions are known wherein measures are taken to prevent contact between a contained article and the internal surfaces of the exterior walls of the carton. For example, U.S. Pat. No. 4,438,848 discloses a cushioning carton wherein a folding carton has an integral, internal support including a pair of tubular members for receiving portions of a packaged article and cushioning it against contact with the carton walls.

It is also known from U.S. Pat. No. 5,788,077 to provide a cushioning measure at the underneath of the contained article, so as to provide a spacing between the underside of the contained article and the surface of the base of the carton.

SUMMARY OF THE INVENTION

The present invention seeks to provide an alternative cushioning measure in a convenient and effective manner within a packaging insert for the item, to be located within the interior of a carton.

According to one aspect of this invention there is provided an insert suitable for placement within a carton, the insert comprising a support panel capable of supporting an article to be located within the carton, and a pair of leg panels extending convergently downwardly from opposing side edges of said support panel into abutment at edges of said leg panels.

Each such leg panel preferably includes a foot panel, extending away from the said edge of both leg panels. The said edge of each leg panel is preferably defined by a fold line, which separates a foot panel from a leg panel.

When the foot panels are folded to extend away at an acute angle from the adjoining leg panel, to become generally coplanar, movement of the foot panels when coplanar towards each other may cause or facilitate the abutment of said leg panels. The shape and dimensions of leg and foot panels are preferably such that upon placement of the insert into a carton, the sidewalls of the carton cause the foot panels to bring lower edges of the leg panels into abutment.

The said support panel may include an article-receiving aperture. Each of the leg panels may, if required, be formed with article-receiving apertures. Such apertures can be of assistance in retaining the article more securely within the insert, and in avoiding contact between the surfaces of the article and the carton walls.

Where present, article-receiving apertures within the leg panels can conveniently be formed from tabs struck into the leg panels. The tabs can thereby form an additional supporting member for, e.g. the underside of a perfume bottle.

The insert may further comprise a plurality of article-protecting panels, which can be folded to form an enclosure for the article to space external surfaces of the article other than the base away from the carton walls.

According to a second aspect of this invention there is provided a blank from which an insert according to the first aspect can be folded, in which the blank includes a support panel capable of supporting an article thereon, a pair of leg panels extending from opposed side edges of the support panel and a pair of foot panels extending from opposed side edges of the leg panels, each leg panel separated from the support panel by a fold line, each foot panel separated from a leg panel by a fold line forming an edge of the leg panel whereby folding of both foot panels and leg panels into generally z-shaped configurations including the support panel enables the edges of the leg panels at said fold lines to be brought into abutment.

BRIEF DESCRIPTION OF THE DRAWINGS

In order that the invention and further preferred and optional features thereof may be illustrated and readily carried into effect, embodiments thereof will now be described by way of non-limiting example only, with reference to the accompanying drawings wherein.

DETAILED DESCRIPTION OF THE PREFERRED EMBODIMENTS

Figure 1:
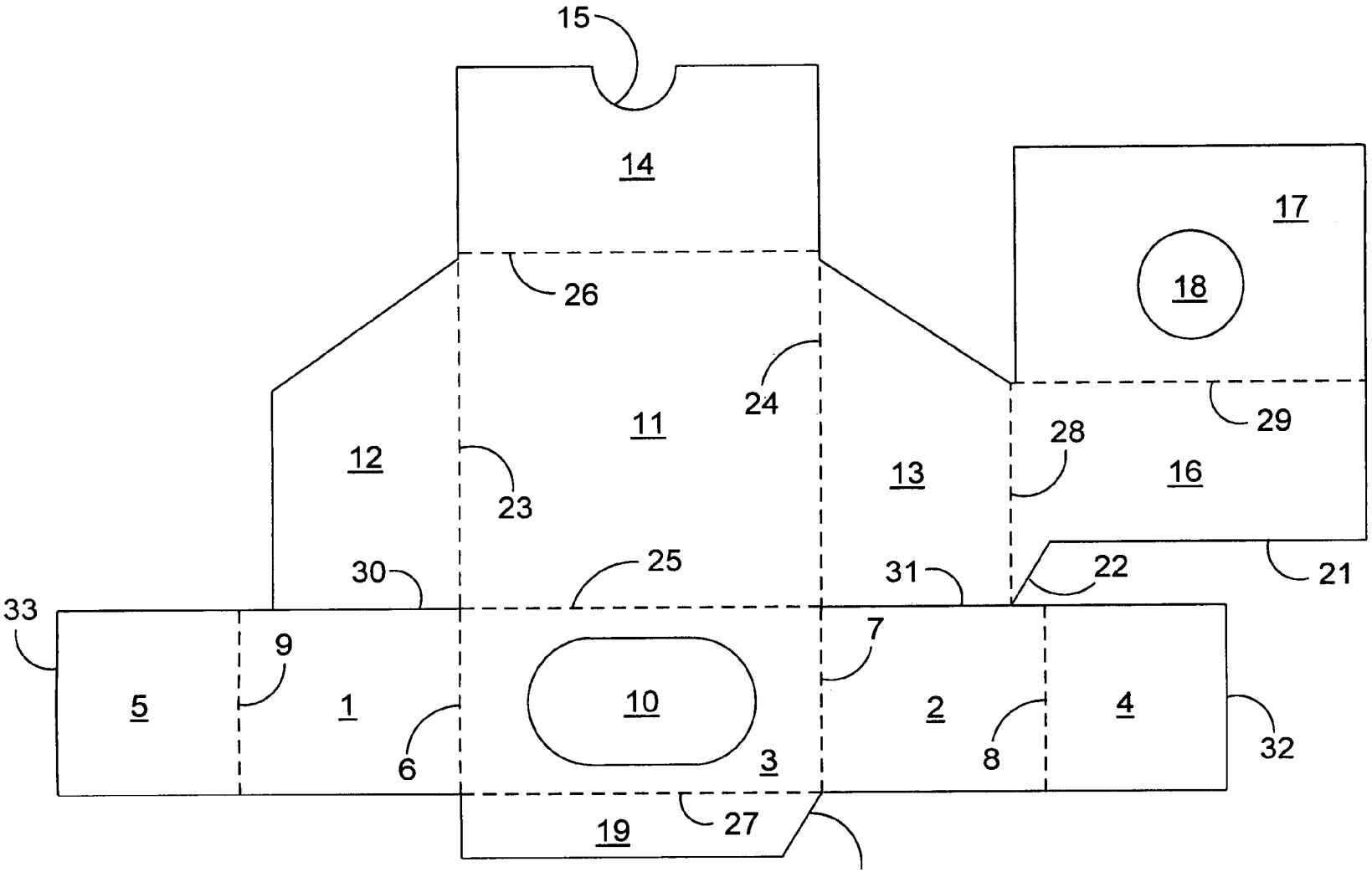
FIG. 1 is a plan view of a blank suitable for folding into a carton insert according to the present invention.

Referring initially to FIGS. 1, 2, 8 & 9 of the drawings, a one-piece blank fabricated from paperboard or corrugated cardboard is shown. Of course, the blank can be formed from other foldable sheet material, without departing from the scope of invention.

A generally rectangular support panel 3, 103 is provided with an article-supporting aperture 10, 110 centrally located therein. Integrally formed with the support panel and extending away from side edges thereof defined by fold lines 6, 7, 106, 107, are leg panels 1, 2, 101, 102 that are, in this embodiment, rectangular. Integrally formed with and extending from edge-forming fold lines 8, 9, 108, 109 are rectangular foot panels 4, 5, 104, 105 having outermost ends 32, 33, 132, 133 respectively. A locating tab 19, 119 extends from the front fold line 27, 127 of the support panel 3, 103, which tab has a leading edge 20, 120 extending, preferably, at an obtuse angle with respect to the front edge of leg panels 2, 102.

A rear panel 11, 111 is provided which extends from the rear fold line 25, 125 of the support panel 3, 103. Side flaps 12, 13, 112, 113 extend from the rear panel 11, 111 at fold lines 23, 24, 123, 124 and are free to fold by virtue of cut lines 30, 31, 130, 131 in the blank between those side flaps 12, 13, 112, 113 and the adjacent edges of leg panels 1, 2, 101, 102. In the embodiment shown in FIGS. 8 and 9, these cut lines 130, 131 further extend part way along the foot panels 104, 105.

A top panel 14, 114 is also provided, extending from uppermost fold line 26, 126 of the back panel 11, 111. This top panel includes a cutout portion 15, 115 intended to allow user's finger to engage top panel 14 after the insert is folded around an article such as a perfume bottle and placed into the corresponding carton.

One of the side flaps 13, 113 in both embodiments is provided with a front panel 16, 116 to extend from a fold line 28, 128 along which that front panel 13, 113 is connected to the adjacent side flap 13, 113. The front panel 16, 116 has a lower external edge 21, 121 terminating at an abutment edge 22, 122, which, upon folding to final shape, abuts a co-operating edge 20, 120 of the locating tab 19, 119.

Extending from the upper edge, defined by fold lines 29, 129, of front panel 16, 116 is an article enclosure panel 17, 117 of rectangular shape. This panel is conveniently provided with an article-engaging aperture 18, 118 to assist location and retention of the intended article within the assembled insert.

Figure 2:
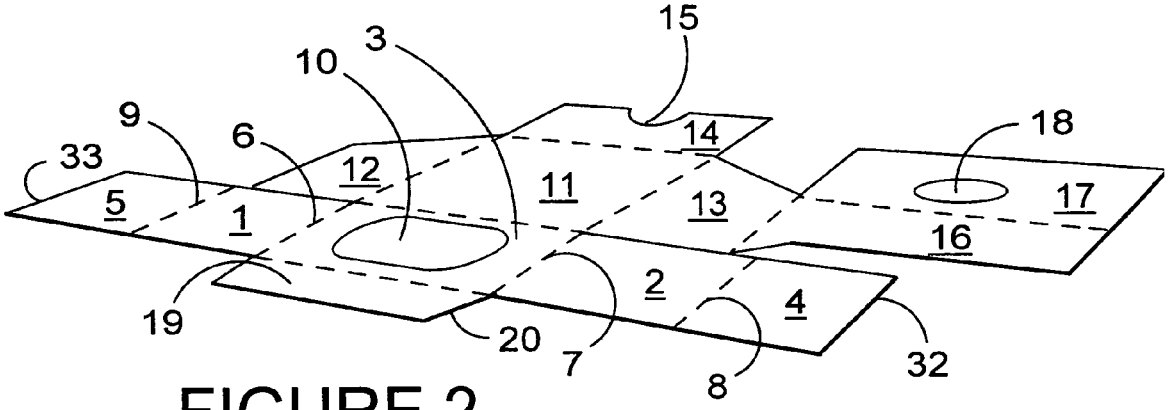
FIG. 2 is an isometric view of the blank of FIG. 1.
Figure 3:
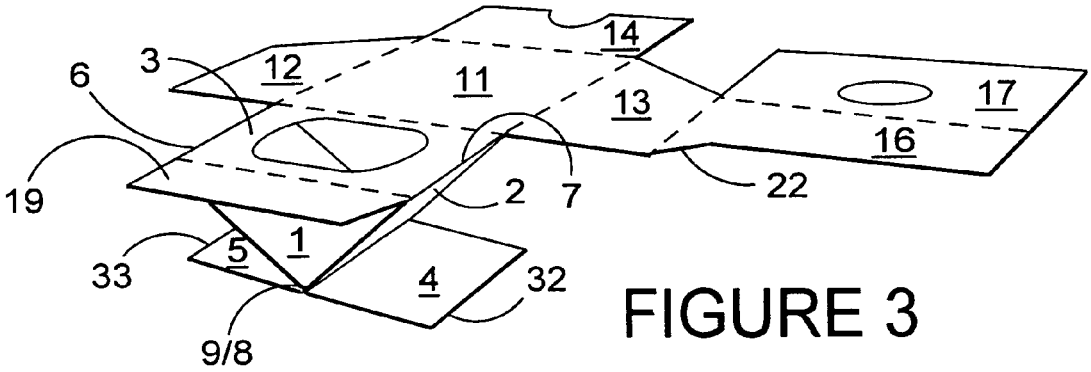
FIG. 3 is an isometric view of the blank of FIGS. 1 and 2 after partial assembly.
Figure 9:
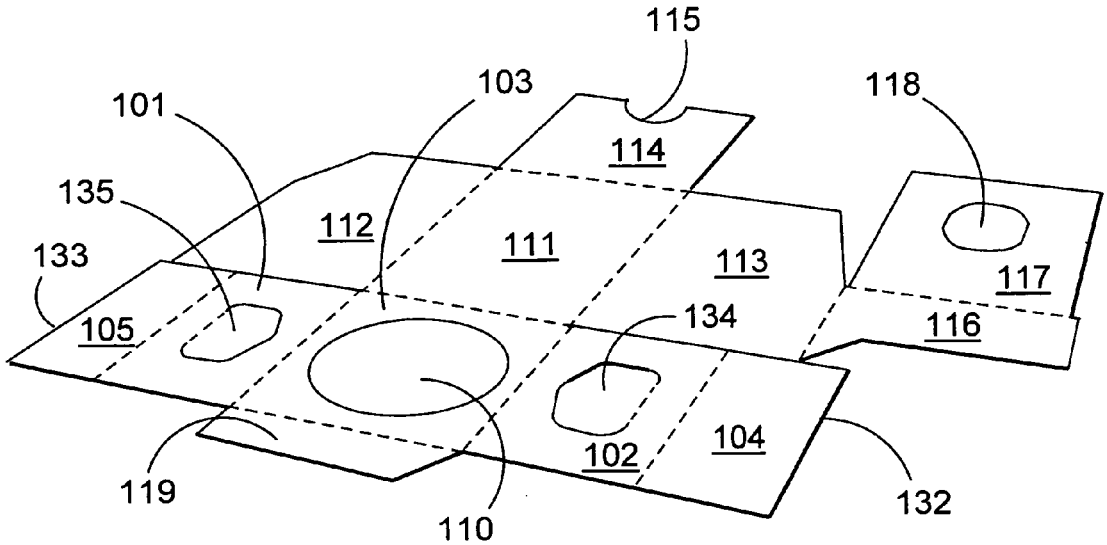
FIG. 9 is an isometric view of the insert blank of FIG. 8.
Figure 10:
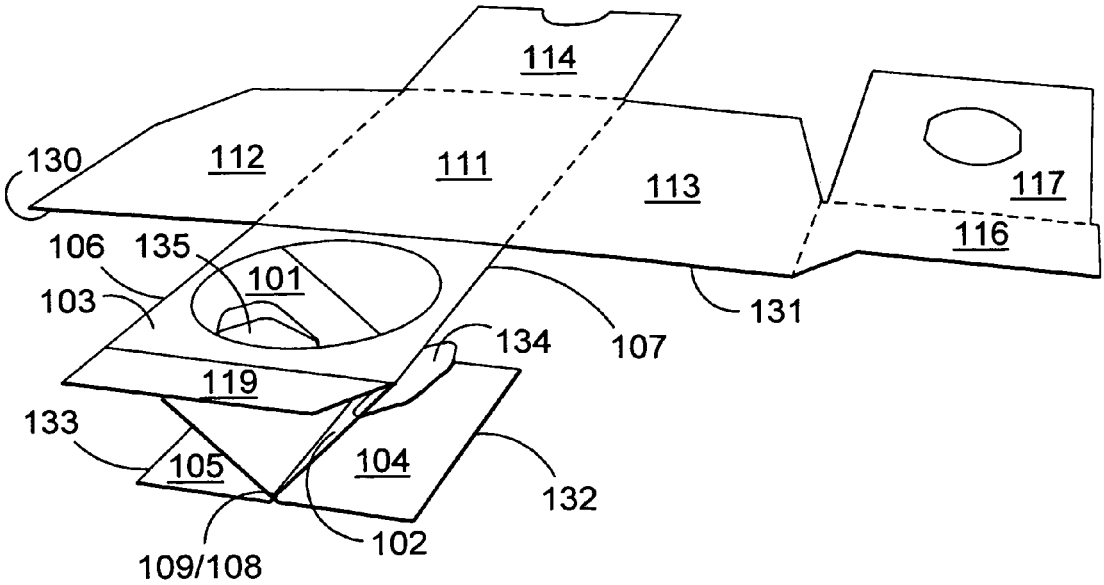
FIG. 10 is an isometric view of the blank of FIG. 9 after partial assembly.

With reference to FIGS. 3 and 10, the insert has been partially folded to an arrangement incorporating a cushioning structure underneath the support panel 3, 103. From the FIGS. 2 and 9 illustrations, the leg panels 1, 101, 2, 102 are folded underneath the support panel 3, 103 in a downwardly converging manner. The foot panels 4, 5, 104, 105 have also been folded but in a direction opposite to the folding of the leg panels. With the two leg panels folded from fold lines 6, 7, 106, 107 in this downwardly converging manner, and the foot panels folded back over fold lines 8, 9, 108, 109 to extend outwardly away from the folded edges (at fold lines 8, 9, 108, 109) thereby formed at the ends of the leg panels, these edges are accordingly brought into abutment contact.

Since the foot panels 4, 5, 104, 105 thereby become splayed in the same plane generally parallel to the plane of the support panel 3, 103, bringing together the splayed foot panels creates, and when inserted into an appropriate carton maintains, the abutment contact at the lowermost edges of the leg panels 1, 2, 101, 102. The leg panels in "V" formation are strengthened and additionally supported by the splayed foot panels 4, 5, 104, 105, particularly when the insert has been packaged into a carton wherein the length of carton base approximates or matches the total length of the two splayed foot panels.

Figure 4:
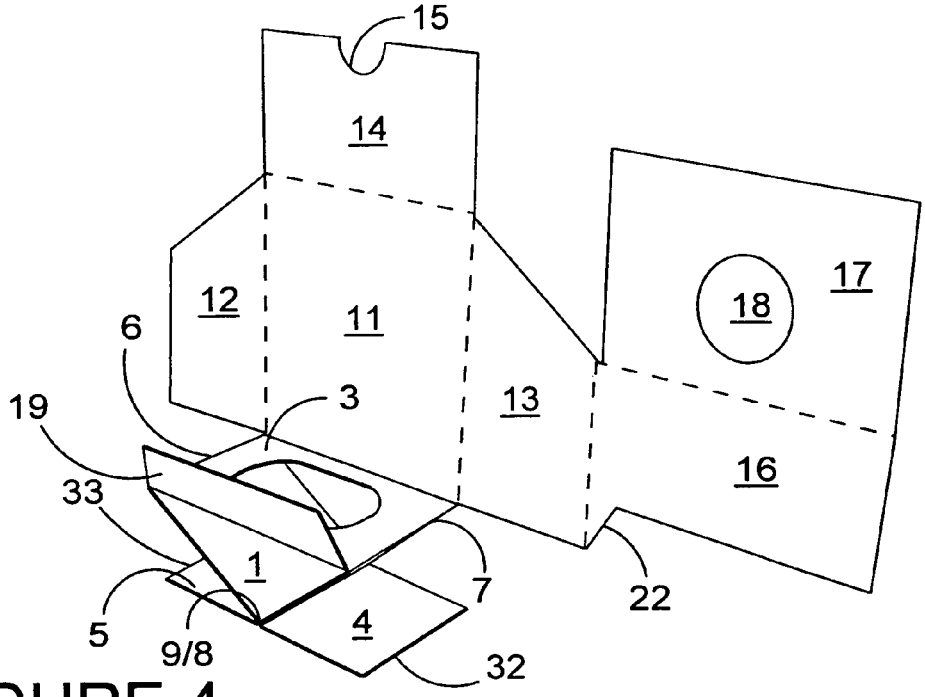
FIG. 4 is an isometric view of the same blank after further folding and partial assembly.
Figure 5:
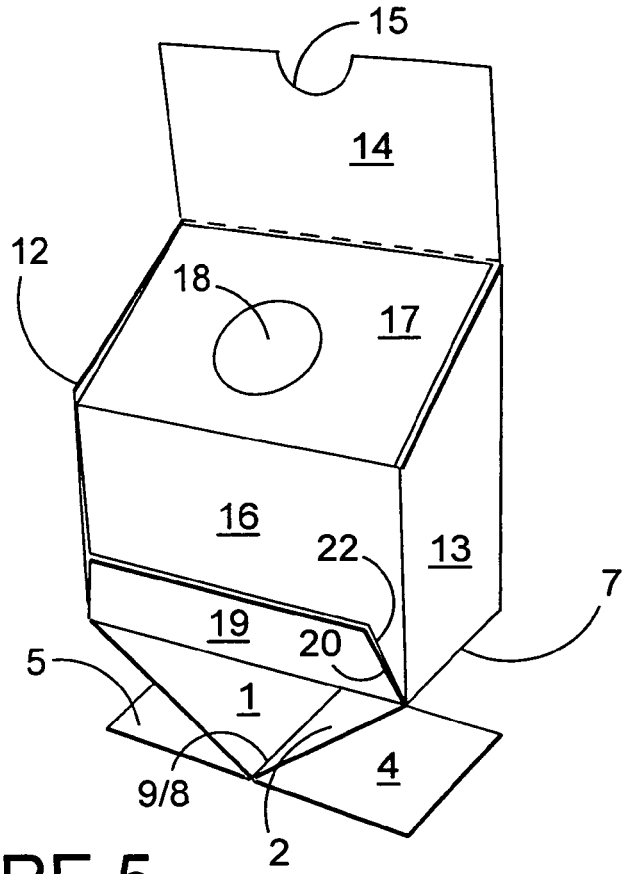
FIG. 5 is an isometric view of the same blank after further folding towards almost complete assembly.
Figure 11:
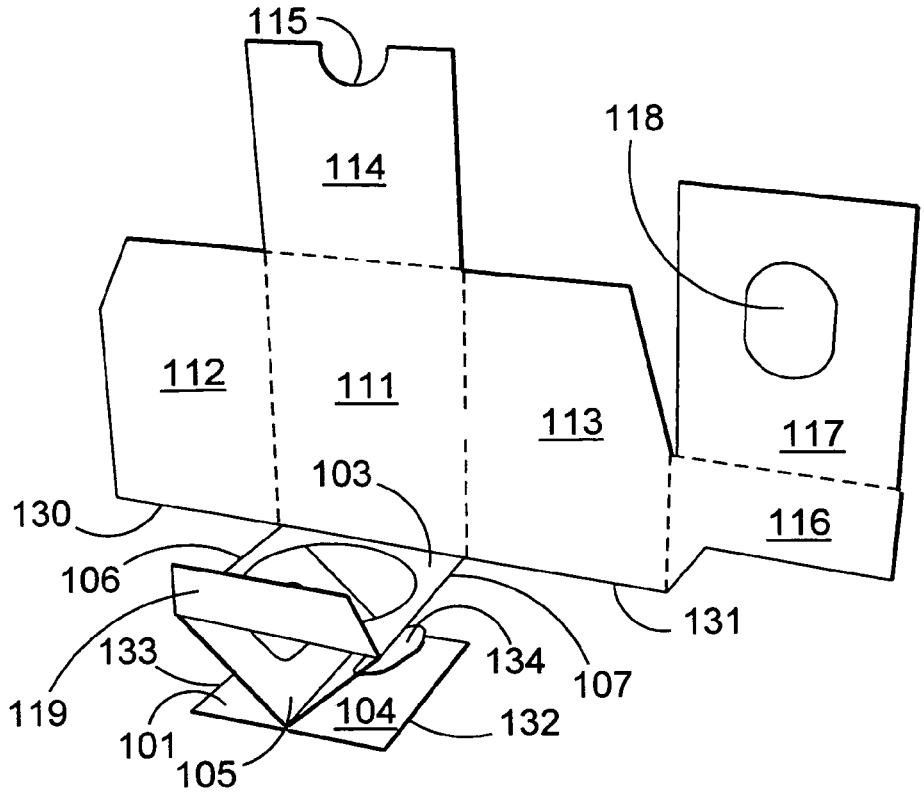
FIG. 11 is an isometric view of the blank of FIG. 10 after further folding assembly.
Figure 12:
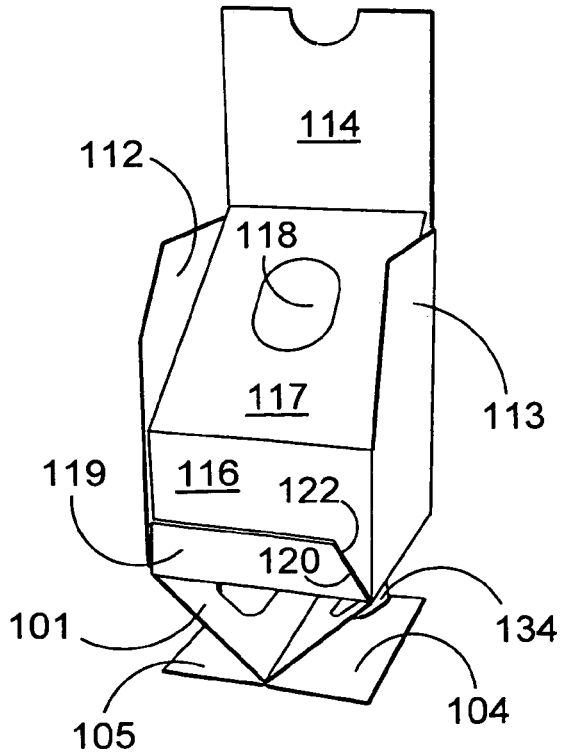
FIG. 12 is an isometric view of the blank of FIG. 11 after further folding towards almost complete assembly.

In the FIGS. 4 and 11 arrangements, additional components of the insert blank have been folded. Thus back panel 11, 111 has been folded about fold line 25, 125 through 90°. In FIGS. 5 and 12, the side flaps 12, 13, 112, 113 have been folded through 90 degrees along fold lines 23, 24, 123, 124, the front panel 16, 116 has been folded through 90 degrees about fold line 28, 128, and the article enclosure panel 17, 117 has been folded through an acute angle so that the free end of the enclosure panel 17, 117 resides in the region of, and may abut, the fold line 26, 126 between back panel 11, 111 and top panel 14, 114. When the front panel 16, 116 is folded about fold lines 28, 128, edges 22, 122, 20, 120 may align optionally in abutment.

Figure 6:
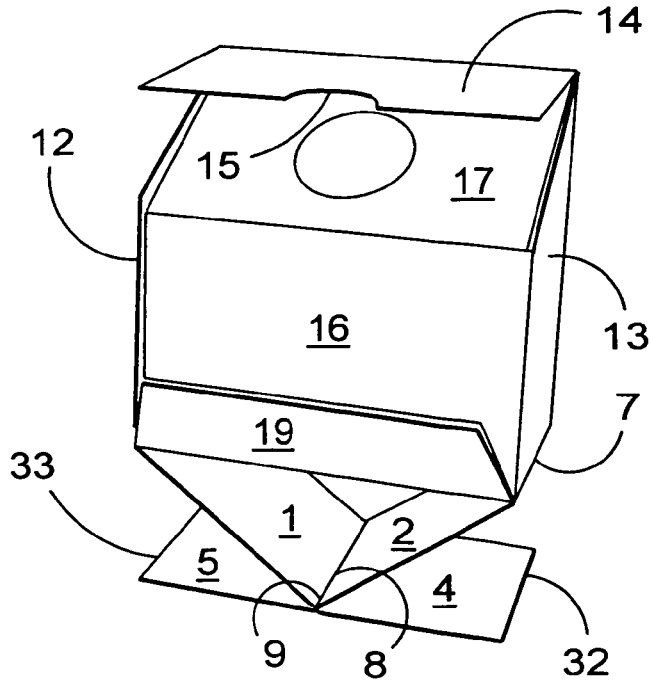
FIG. 6 is an isometric view of the same blank in fully folded form, i.e., the form of an insert, suitable for insertion into a conventional carton.

As shown in FIG. 6, the top panel (14) is folded forwards about the fold line 26 through about 90 degrees such that the cutout portion does not align with the aperture 18. This arrangement allows the top panel 14 to serve as a protection cover for at least minimising damage to a cap or top of a contained article such as a perfume bottle. The cut out portion 15 would be used as a finger hole for facilitating a user to lift the top panel 14 when the carton is opened from the top.

Figure 7:
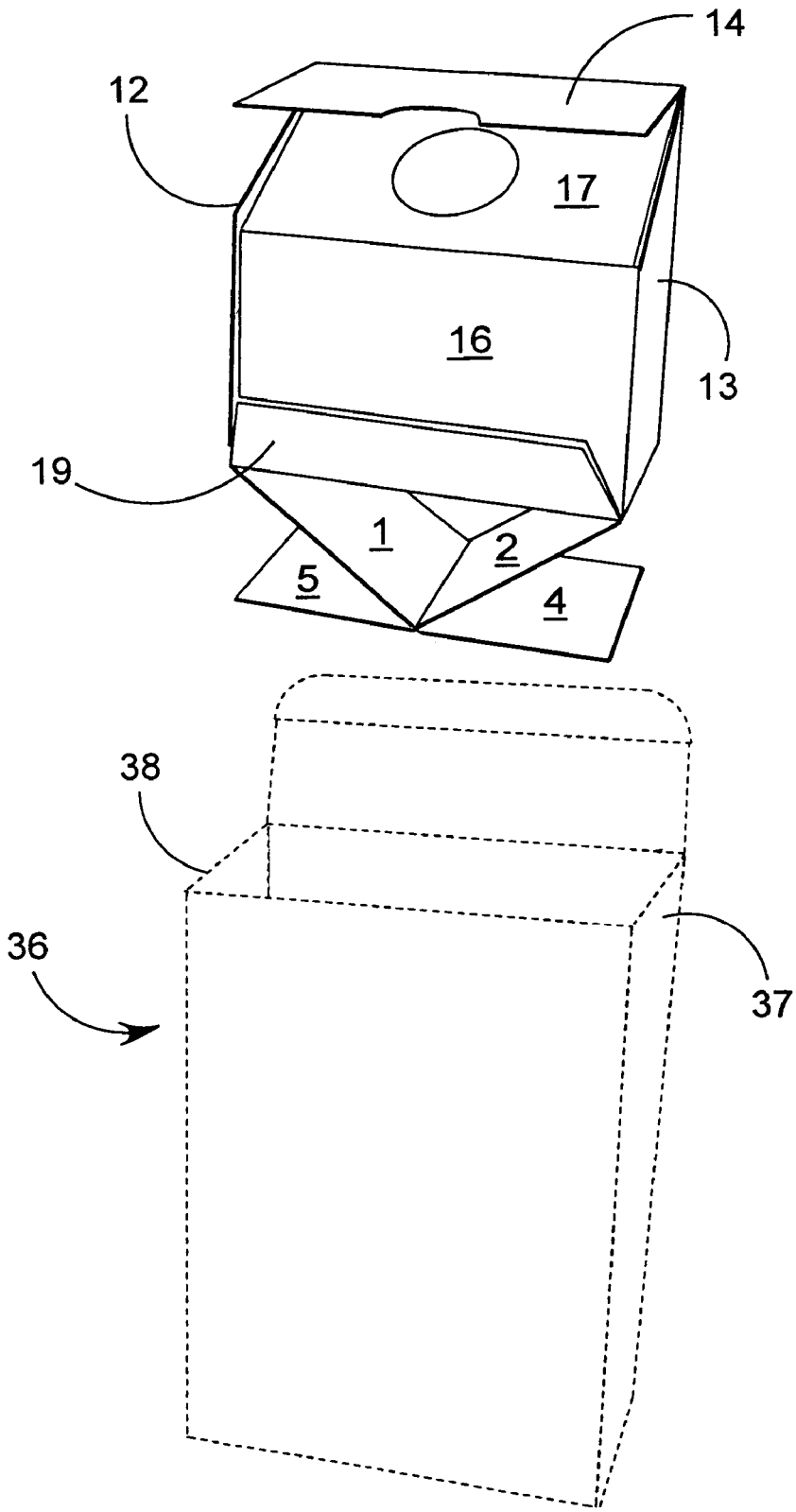
FIG. 7 is an illustration of insertion of the assembled insert into a corresponding carton.
Figure 8:
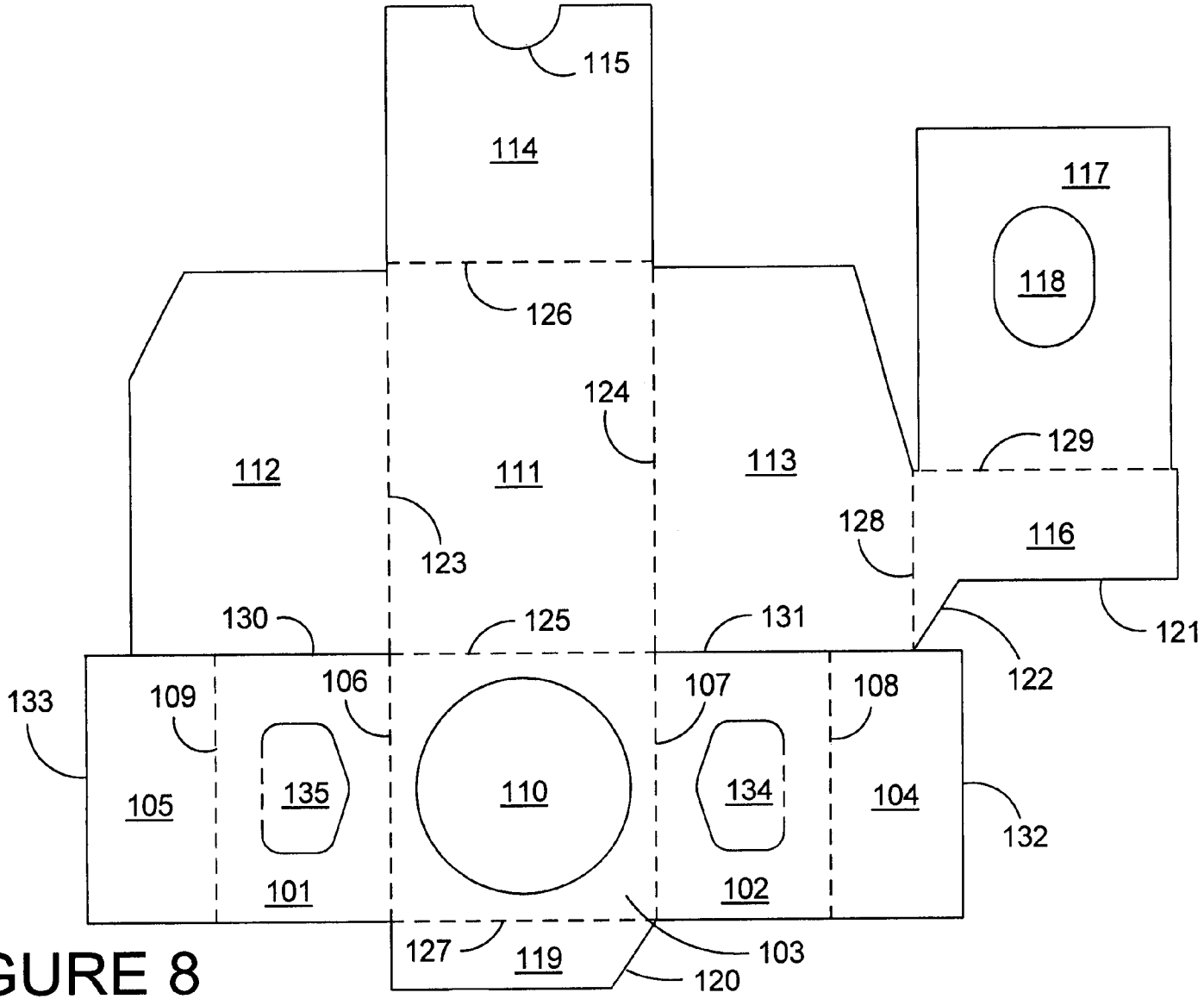
FIG. 8 is a plan view of a second embodiment of the insert blank according to the present invention.
Figure 13:
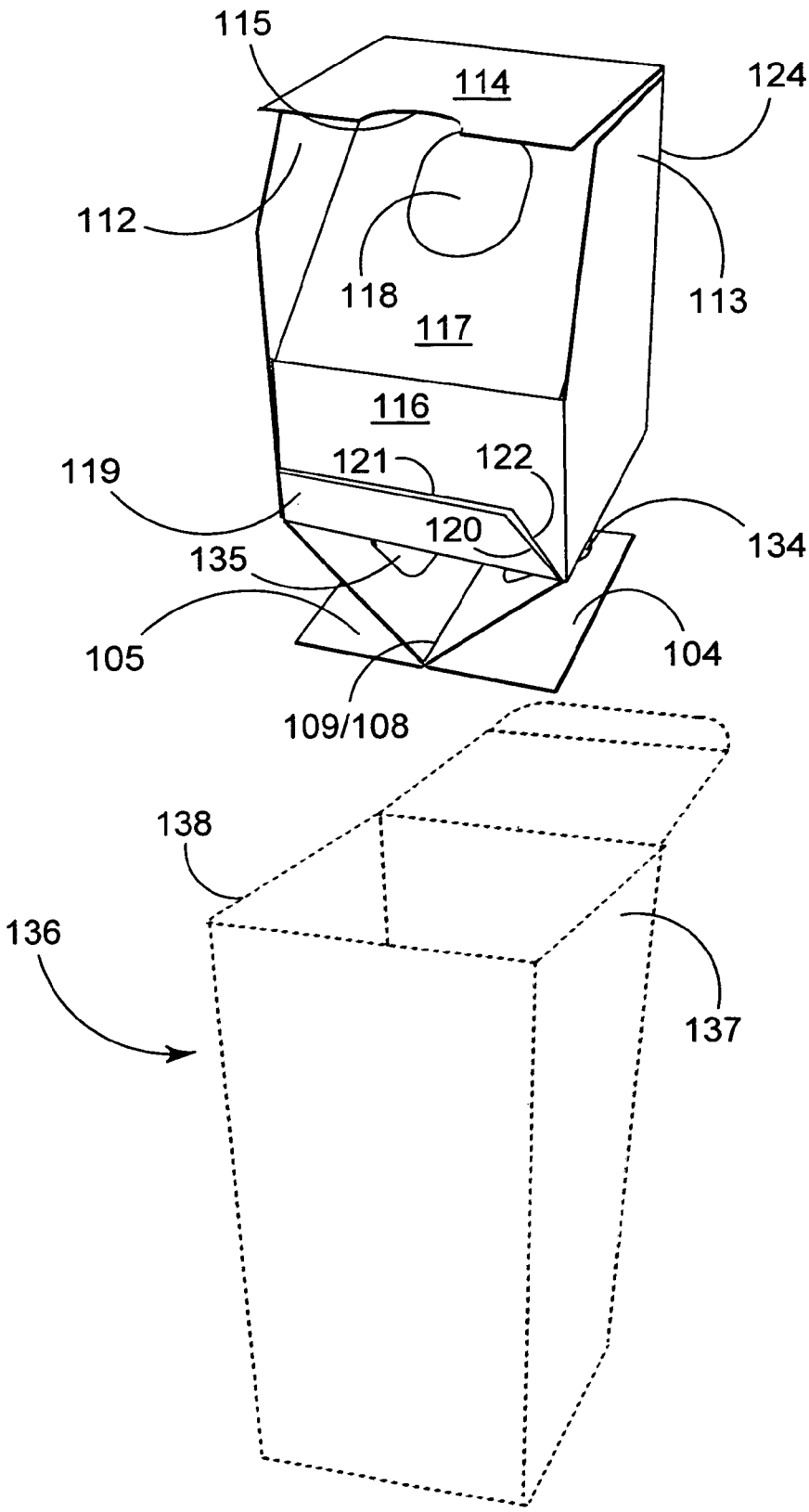
FIG. 13 is an isometric view of the blank of FIG. 12 in fully folded and assembled form, i.e., the form of an insert, showing the fully folded and assembled insert at the point of insertion into a carton of different shape and size from that illustrated in FIG. 7.

FIGS. 7 and 13 demonstrate insertion of the assembled insert (in the absence of a contained article) into a carton 36, 136 of appropriate shape and dimension. It is most preferred for the remote ends of the splayed foot panels 4, 5, 104, 105 to be generally aligned in the plane of the folded side panels 12, 13, 112, 113 and the corresponding ends of the support panels 3, 103. Accordingly, when the assembled insert is placed into a carton of the appropriate shape and dimensions, the splayed foot panels 4, 5, 104, 105 are pressed together by the internal sidewalls, 37, 38, 137, 138 of the carton and kept together such that the lowermost edges of the foot panels are maintained in abutment.

Accordingly, a convenient cushioning means is provided to the potentially fragile base of a contained article, by virtue of a spacing between the base of the carton and the base of the contained article. This reduces the risk of breakage or damage to the contained article, whilst simultaneously reducing or avoiding contact between other external surfaces of the contained article and internal surfaces of the walls of the carton.

In the differing embodiment shown in FIGS. 8 to 13, the corresponding insert blank is struck with a pair of tabs 134, 135 forming article retention apertures when the tabs are pressed out of alignment with the corresponding leg panels 101, 102. The base of a contained article may thus pass through the aperture 110 in the support panel 103 to locate within apertures (see FIGS. 11 and 12) created from the tabs. The base of an article may also be additionally supported by the tabs themselves, providing greater stability without interfering with the cushioning effect conferred by the generally z-shaped formation of support panel, leg panel and foot panel wherein the lowermost edges of the two foot panels are held in abutment.

It will be recognised that as used herein, directional references such as "top", "base" "front", "rear", "end", and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and its preferred embodiment relates to an insert which is shaped to provide satisfactory rigidity to hold items such as perfume or cosmetics securely but with a degree of flexibility. The shape of the blank minimises the amount of paperboard required for the carton. The inserts can be applied to articles by hand or automatic machinery. It is anticipated the invention can be applied to a variety of inserts and not limited to those having front, rear, side and/or top panels.

What is claimed is:

1. An insert suitable for placement within a carton, the insert comprising a support panel for supporting an article to be located within the carton, a plurality of article-protecting panels folded to form an enclosure for the article so that external surfaces of the article are spaced away from walls of the carton, and a pair of leg panels extending convergently downwardly from opposing side edges of said support panel into abutment at lower edges of said leg panels.

2. An insert according to claim 1, wherein each of the leg panels is provided with a foot panel, the foot panels extending away from each other from said lower edges of said leg panels respectively.

3. An insert according to claim 2, wherein the said lower edge of each leg panel is defined by a fold line along which said each leg panel is connected to a respective one of said foot panels.

4. An insert according to claim 2, wherein the foot panels are folded to extend away at an acute angle from the respective leg panels to become generally coplanar with each other and generally parallel with the said support panel.

5. An insert according to claim 2, wherein the shape and dimensions of the leg panels and foot panels are such that upon placement of said insert into the carton, the spacing between side walls of the carton causes said foot panels to bring said lower edges of the leg panels into abutment.

6. An insert according to claim 1, wherein the said leg panels are folded to form in co-operation a V-shaped configuration with said lower edges of said leg panels maintained in abutment.

7. An insert according to claim 2, wherein the support panel, one of the leg panels, and one of the foot panels extending from said one of the leg panels form a generally Z-shaped configuration.

8. An insert according to claim 1, wherein the support panel includes an article-receivable aperture.

9. An insert according to claim 1, wherein each of the leg panels is formed with at least one article-receivable aperture.

10. An insert according to claim 9 wherein each of said article-receivable apertures is defined by a tab struck from a respective one of said leg panels.

11. An insert according to claim 10 wherein the tabs are folded to form additional supporting members for the article.

12. An insert according to claim 1 wherein at least one of said article-protecting panels includes an aperture in which part of the article can be received and supported.

13. An insert according to claim 1, which is of one-piece construction.

14. An insert according to claim 1 wherein the support panel is provided with a locating tab extending from a fold line of the support panel and having a leading edge adapted to engage a cooperating formation of a panel of the insert spaced from the support panel.

15. An insert as claimed in claim 1 wherein said insert is in fully folded form that co-operate with a carton of shape and dimension that provides a close fit between said insert and said carton.

16. A package comprising a carton, an article received within said carton and an insert suitable for placement within said carton, the insert comprising a support panel for supporting said article, a plurality of article-protecting panels folded to form an enclosure for said article so that external surfaces of said article are spaced away from walls of said carton, and a pair of leg panels extending convergently downwardly from opposing side edges of said support panel into abutment at lower edges of said leg panels.

17. A package according to claim 16, wherein said article is a fragile article, said support panel including a first aperture in which said article is received, a base of said article resting upon said leg panels.

18. A package as claimed in claim 17 wherein each of said leg panels has a second aperture and a tab extending away from said second aperture such that said base of said article contained within said insert is received in said second apertures and at least part of said tabs extend from said leg panels.

19. A package according to claim 18 wherein an upper part of said article projects through a third aperture in an additional panel of said insert, said additional panel being spaced from said support panel.

20. A one-piece blank for forming an insert for placement into a carton, said insert includes a support panel for supporting an article thereon, a pair of leg panels extending from opposed side edges of said support panel and a pair of foot panels extending from respective side edges of said leg panels opposite said support panel, each of said leg panels being connected to said support panel by a first fold line, each of said foot panels being connected to an adjacent one of said leg panels by a second fold line forming an edge of said adjacent leg panel whereby folding of both said foot panels and said leg panels into generally z-shaped configurations including said support panel enables said edges of the leg panels at said second fold lines to be brought into abutment.

* * * * *